US007055181B2

(12) United States Patent
Moormann et al.

(10) Patent No.: US 7,055,181 B2
(45) Date of Patent: Jun. 6, 2006

(54) SWIM GOGGLES

(75) Inventors: Randall H. Moormann, Georgetown, MA (US); Ronald R. Daley, Beverly, MA (US)

(73) Assignee: Aqua-Leisure Industries, Inc., Avon, MA (US)

( * ) Notice: Subject to any disclaimer, the term of this patent is extended or adjusted under 35 U.S.C. 154(b) by 22 days.

(21) Appl. No.: 10/970,672

(22) Filed: Oct. 20, 2004

(65) Prior Publication Data

US 2006/0085896 A1 Apr. 27, 2006

(51) Int. Cl.
*A61F 9/02* (2006.01)

(52) U.S. Cl. ..... 2/448; 2/445

(58) Field of Classification Search ..... 2/426, 2/428, 445, 448; 351/43
See application file for complete search history.

(56) References Cited

U.S. PATENT DOCUMENTS

| | | | |
|---|---|---|---|
| 4,527,292 | A | 7/1985 | Kasama et al. |
| 4,607,398 | A | 8/1986 | Faulconer |
| 5,046,198 | A | 9/1991 | Hunnebeck |
| 5,181,280 | A | 1/1993 | Zachry, Jr. |
| 5,555,571 | A | 9/1996 | McCaffrey |
| 5,566,427 | A | 10/1996 | Lathrop |
| 5,611,644 | A | 3/1997 | Lutz |
| 5,657,493 | A | 8/1997 | Ferrero et al. |
| 5,711,036 | A | 1/1998 | Kita et al. |
| 5,727,259 | A | 3/1998 | Kawamata |
| 5,809,580 | A | 9/1998 | Arnette |
| 5,839,175 | A | 11/1998 | Lin |
| 5,894,606 | A | 4/1999 | Chiang |
| 5,896,588 | A | 4/1999 | Chiang |
| 5,914,766 | A | 6/1999 | Berke |
| 5,915,540 | A | 6/1999 | Chou |
| 5,926,855 | A | 7/1999 | Brodbeck |
| 5,950,248 | A | 9/1999 | Kawashima et al. |

(Continued)

*Primary Examiner*—Katherine M. Moran
(74) *Attorney, Agent, or Firm*—John L. Welch, Esq.

(57) ABSTRACT

Swim goggles comprising first and second substantially rigid frames each having a base portion, an eye lens portion, an inner end portion and an outer end portion. The swim goggles further comprise a bridge for engaging the inner end portions of the first and second frames. The swim goggles further comprise a head strap having first and second end portions having a plurality of tooth portions. The swim goggles further comprise first and second connection mechanisms disposed at the outer end portions of the first and second frames, respectively. Each of the first and second connection mechanisms comprise a strap passage way adapted to receive the first and second end portions of the head strap, respectively. Each of the first and second mechanisms further comprise a unitary resilient pawl comprising a median portion and first and second finger portions having end portions engaged with the base portion at a position adjacent to and below the eye lens portion. The resilient pawl further comprising a button portion extending upwardly from the median portion and a stop portion extending downwardly from the median portion. Each of the first and second connection mechanisms further comprise a cover portion engaged with the base portion and the end portions of said first and second finger portions, respectively. The cover portion has an annular shaped opening adapted to receive the button portion. In operation, movement of the button portion by the person causes the first and second finger portions to become biased and the stop member to become disengaged from the tooth portion of the strap. Release of the button portion causes the stop member to return to its unbiased state and engaged with the tooth portion of the strap.

17 Claims, 7 Drawing Sheets

U.S. PATENT DOCUMENTS 5,956,778 A 9/1999 Godoy
6,052,834 A 4/2000 Chou
6,098,204 A 8/2000 Arnette
6,105,177 A 8/2000 Paulson et al.
6,131,246 A 10/2000 Paulson et al.
6,195,807 B1 * 3/2001 Chou ..... 2/428
6,247,187 B1 * 6/2001 Chiang ..... 2/428
6,276,794 B1 8/2001 Chiang
6,292,983 B1 9/2001 Giaquinta et al.
6,341,383 B1 1/2002 Beltrani
6,349,419 B1 2/2002 Chiang
6,349,420 B1 * 2/2002 Chiang ..... 2/428
6,350,030 B1 2/2002 Fujima
6,446,272 B1 9/2002 Lee
6,532,603 B1 3/2003 Lan
6,581,213 B1 6/2003 Chiang
6,640,347 B1 11/2003 Fukasawa
6,691,377 B1 2/2004 Pan
6,691,378 B1 2/2004 Chou
6,694,532 B1 2/2004 Chen
6,721,963 B1 4/2004 Kawashima
6,745,404 B1 6/2004 Chen-Lieh
6,748,608 B1 6/2004 Fukazawa
6,766,540 B1 7/2004 Kawashima
6,961,965 B1 * 11/2005 Chiang ..... 2/445
2002/0138898 A1 10/2002 Chiang
2002/0170108 A1 11/2002 Chiang
2003/0046751 A1 3/2003 Chiang
2003/0093854 A1 5/2003 Nishida
2003/0172445 A1 9/2003 Kawashima
2003/0233702 A1 12/2003 Chen
2004/0083540 A1 5/2004 Dondero
2004/0158916 A1 8/2004 Sung
2004/0210991 A1 * 10/2004 Chiang ..... 2/445
2005/0132478 A1 * 6/2005 Canavan ..... 2/448

* cited by examiner 12, 13

1.016
.664
.094

1.469

2.353
.508

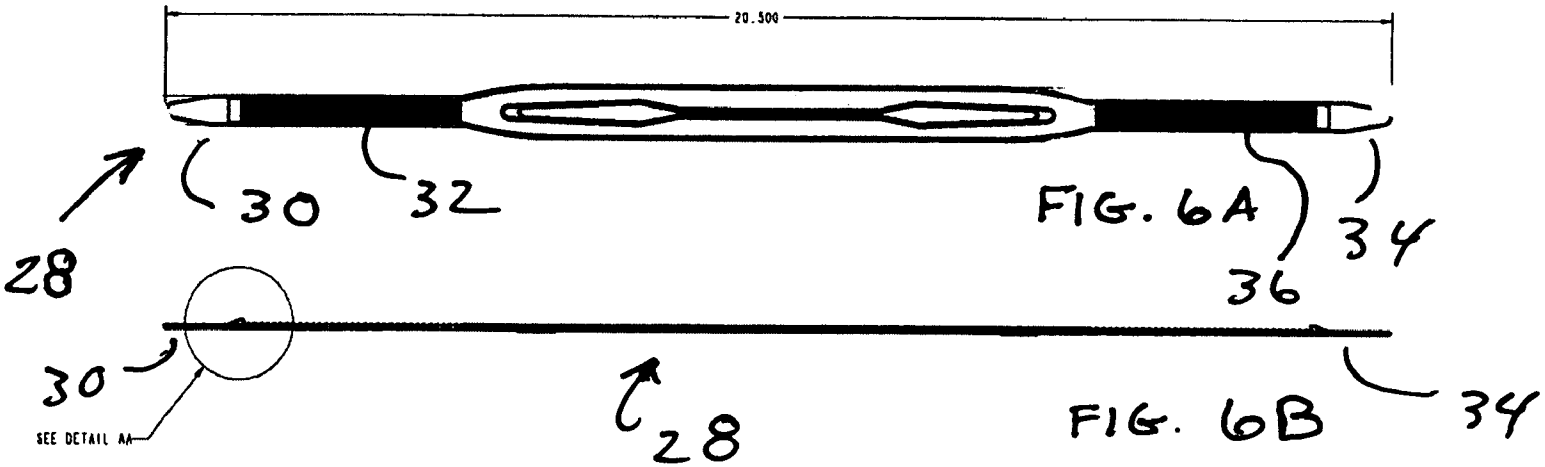
FIG. 6A
FIG. 6B
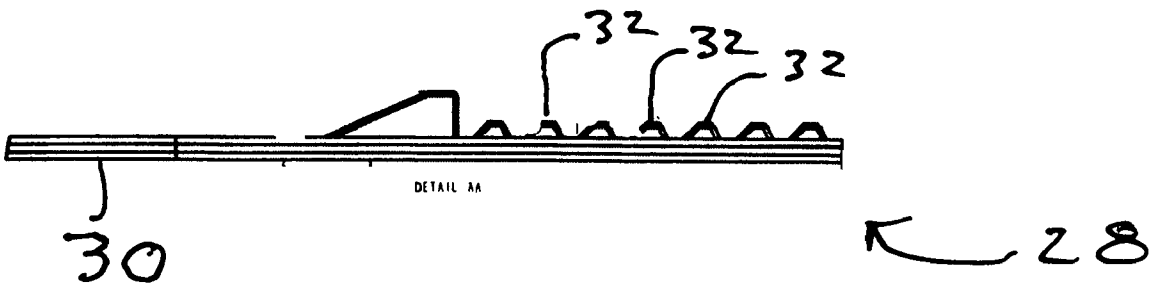
FIG. 6C

.890
.438
50
58
56
52
44

.369

46

44
46
48
59
50
56
53
54
.563

60°
51°
46
44

44

SWIM GOGGLES

BACKGROUND OF THE INVENTION

Conventional swim goggles commonly employ some type of mechanism for adjusting the length of a head strap. Such conventional mechanisms are overly complex and/or unreliable thereby increasing manufacturing costs and the retail price to the consumer. By way of example only, and referring to FIG. 1, a conventional swim goggle 1 is depicted generally consisting of a pair of eye piece frames 2 and 3 each having a silicone backing 4. A nose bridge 5 is provided to connect the eye piece frames 2 and 3 together. A strap 7 is looped around a channel 6 and is fastened by a buckle. Such conventional swim goggles 1 do not allow for simple and reliable adjustment and engagement of the strap 7.

SUMMARY OF THE INVENTION

One object of the present invention was to develop a swim goggle having a simple yet reliable connection mechanism for adjusting the head strap. Another object of the present invention was to develop a swim goggle having a simple and reliable connection mechanism that could be manufactured at a cost significantly less than conventional devices.

The present invention is a swim goggle having a simple mechanism that allows a person to adjust the length of a head strap with a single hand. In a first embodiment, the swim goggles comprise first and second substantially rigid frames each having a base portion, an eye lens portion, an inner end portion and an outer end portion. The swim goggles further comprise a bridge for engaging the inner end portions of the first and second frames. The swim goggles further comprise a head strap having first and second end portions having a plurality of tooth portions. The swim goggles further comprise first and second connection mechanisms disposed at the outer end portions of the first and second frames, respectively. Each of the first and second connection mechanisms comprise a strap passage way adapted to receive the first and second end portions of the head strap, respectively. Each of the first and second connection mechanisms further comprise a unitary resilient pawl comprising a median portion and first and second finger portions having end portions engaged with the base portion at a position adjacent to and below the eye lens portion. The resilient pawl further comprising a button portion extending upwardly from the median portion and a stop portion extending downwardly from the median portion. Each of the first and second connection mechanisms further comprise a cover portion engaged with the base portion and the end portions of the first and second finger portions, respectively. The cover portion has an annular shaped opening to receive the button portion. In operation, movement of the button portion by the person causes the first and second finger portions to become biased and the stop member to become disengaged from the tooth portion of the strap. Release of the button portion causes the stop member to return to its unbiased state and engaged with the tooth portion of the head strap.

BRIEF DESCRIPTION OF THE DRAWINGS

The following description of the invention will be more fully understood with reference to the accompanying drawings in which:

FIGS. 6A–6C are isometric views of the head strap showing the tooth portions;

DESCRIPTION OF THE INVENTION

Figure 1:
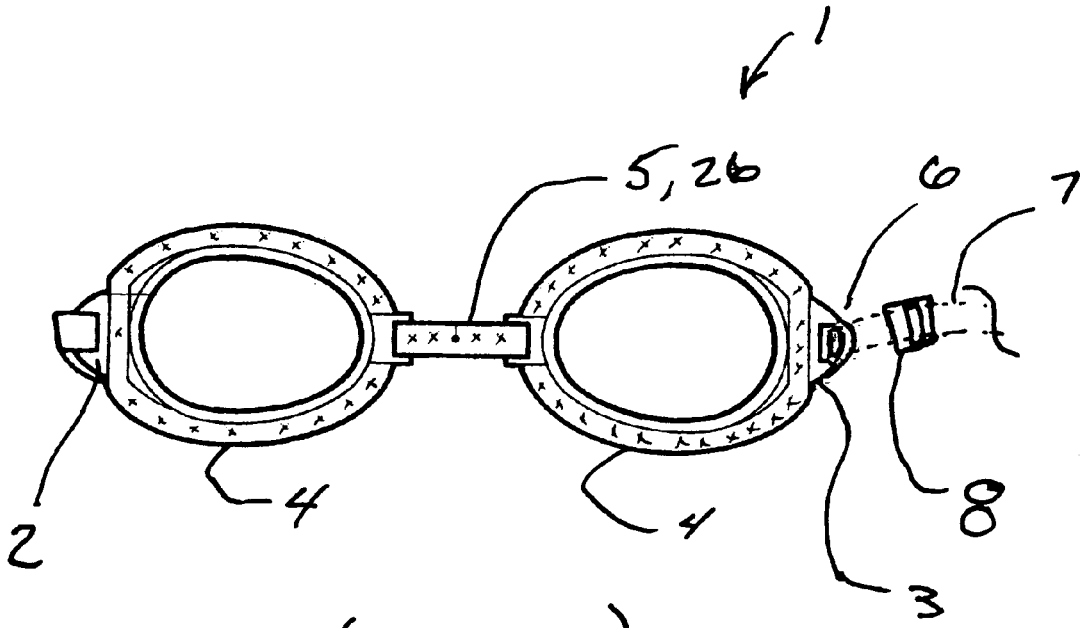
(PRIOR ART) FIG. 1
FIG. 1 is a view of a prior art swim goggle.
Figure 2:
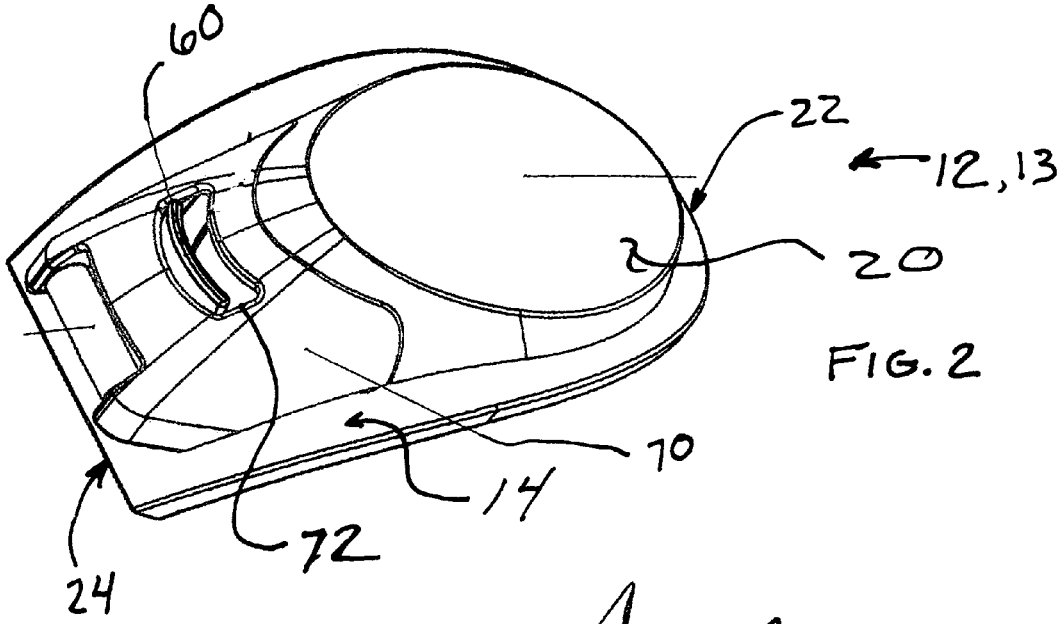
FIG. 2 is a perspective view of a first embodiment of the swim goggles of the present invention (only one goggle being shown)
Figure 3:
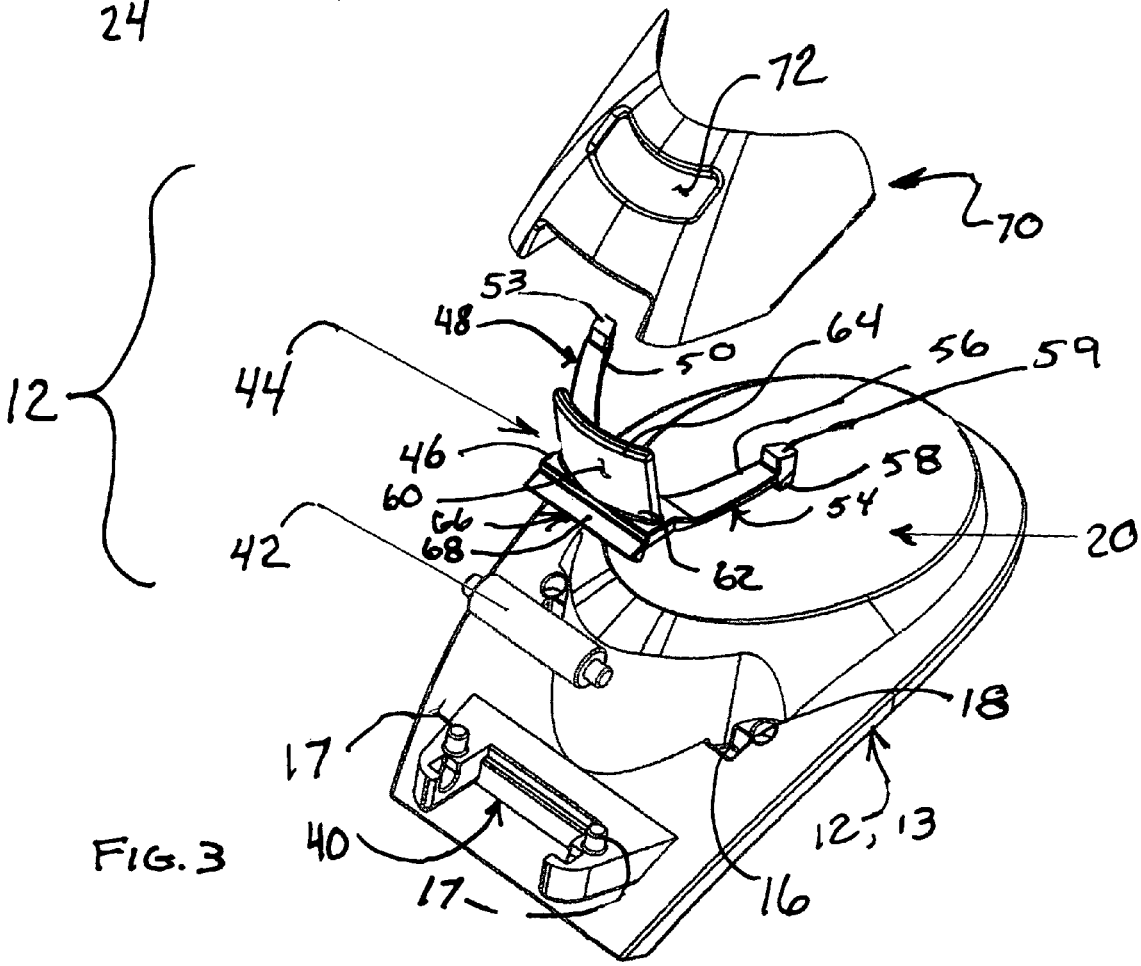
FIG. 3 is an exploded perspective view of the first embodiment of the swim goggles (only one goggle being shown).
Figures 4A, 4B, 4C, 4D, 4E, 4F:
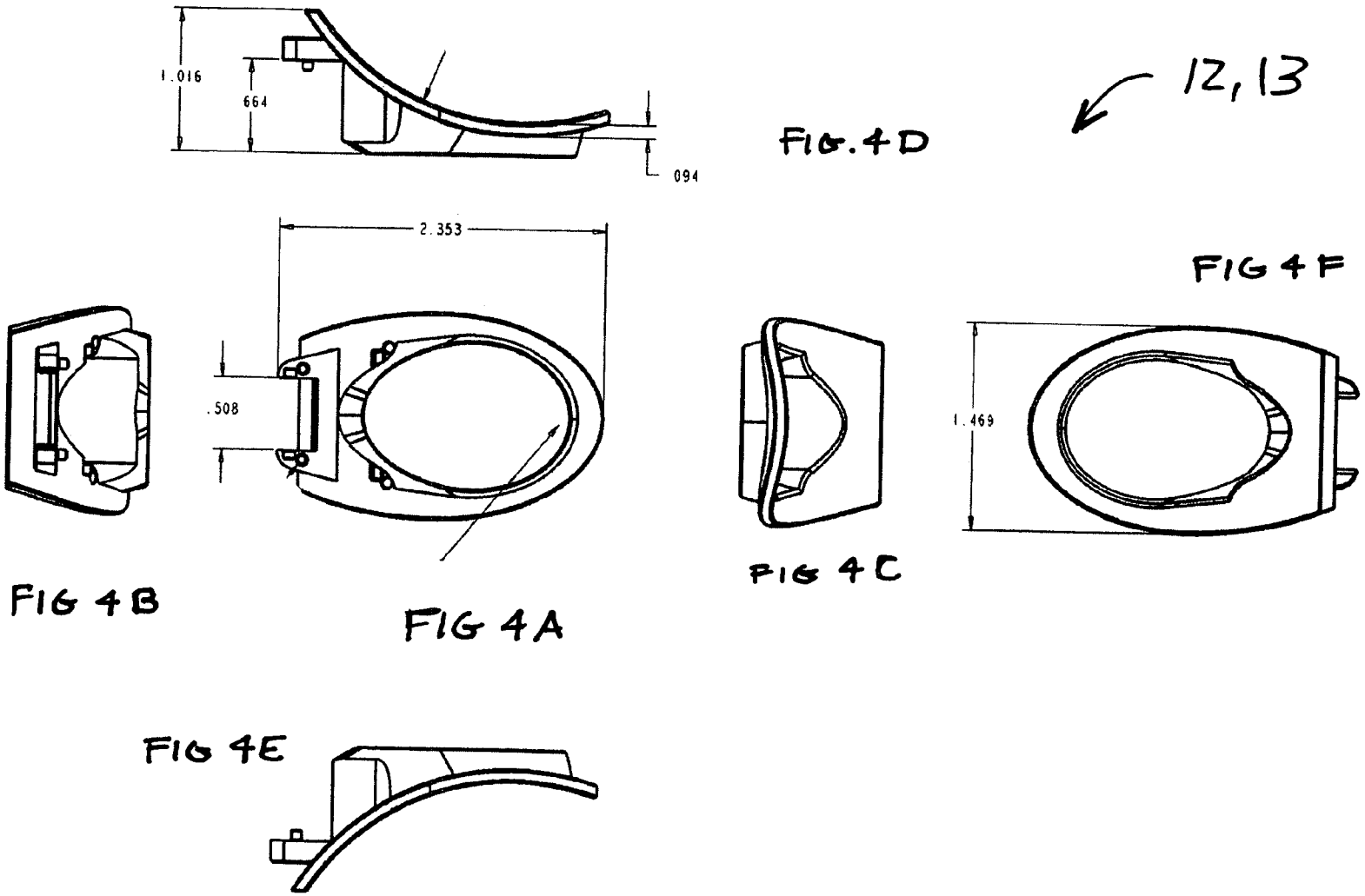
FIGS. 4A–4F are isometric views of the eye piece frame.
Figures 5A, 5B, 5C:
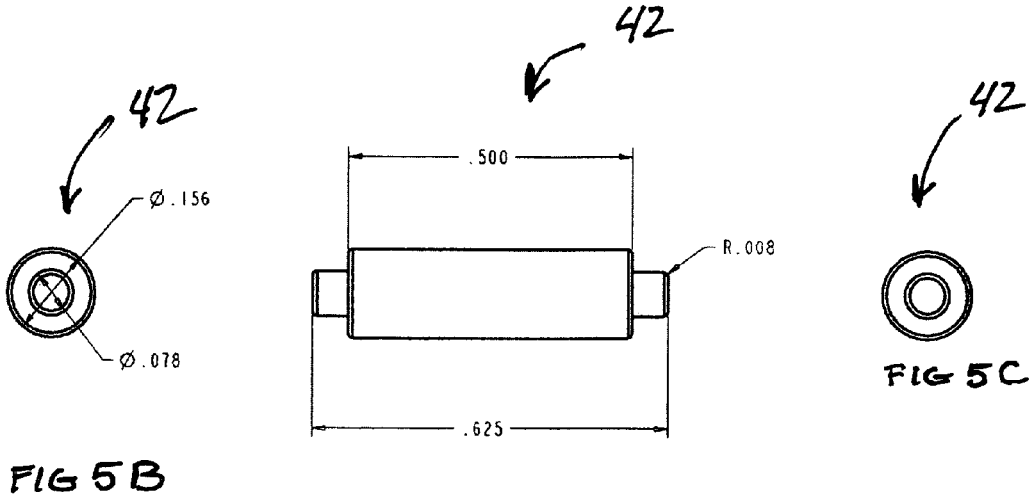
FIGS. 5A–5C are isometric views of the pin.
Figures 7A, 7B, 7C, 7D, 7E, 7F:
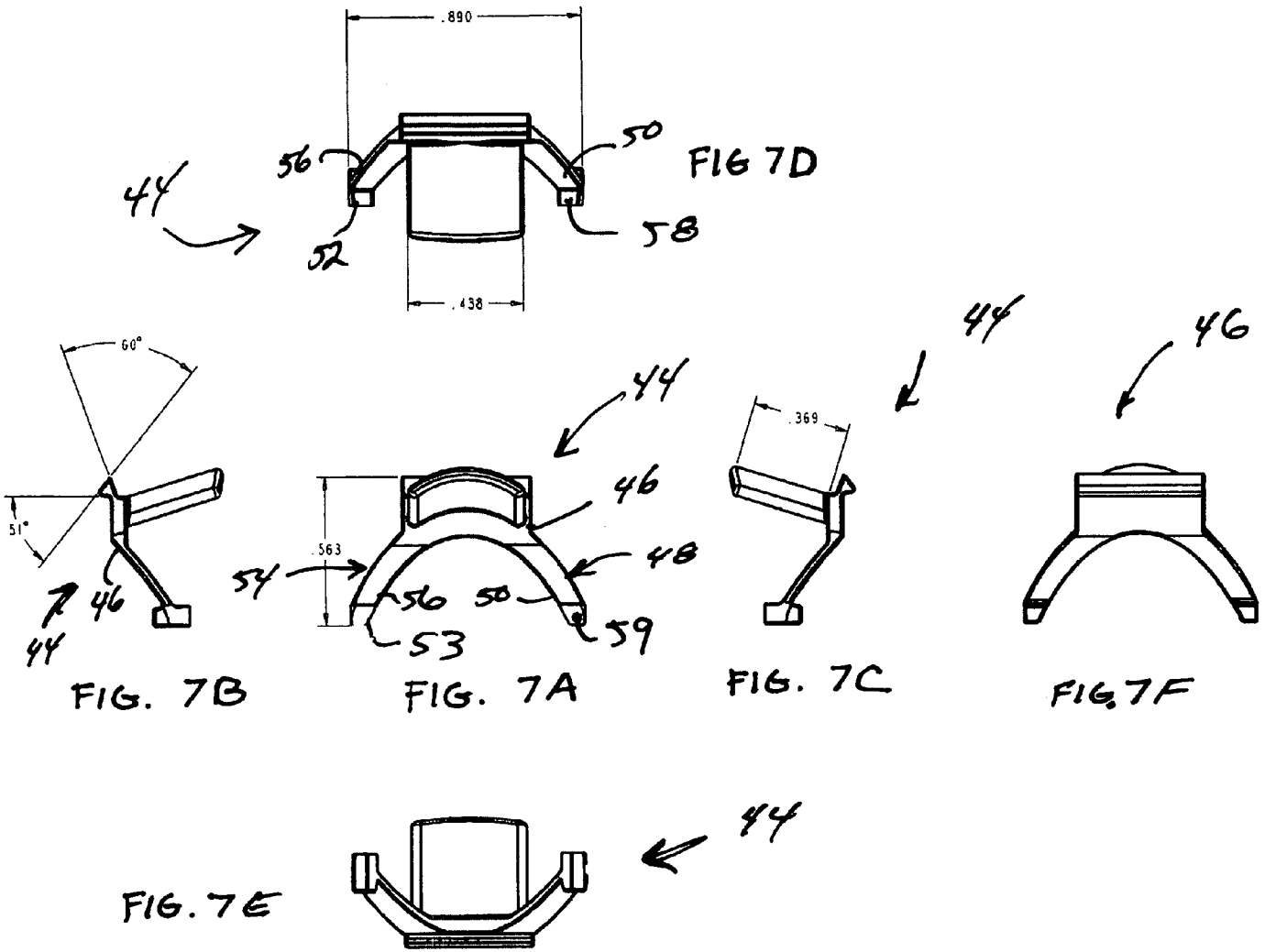
FIGS. 7A–7F are isometric views of the unitary resilient pawl.
Figure 8D:
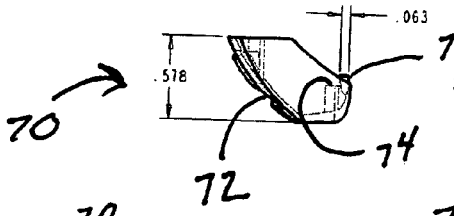
FIGS. 8A–8I are isometric views of the cover portion that engages with the base portion of the eye frame and the unitary resilient member.
Figure 8B:
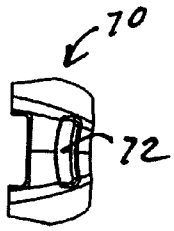
Figure 8A:
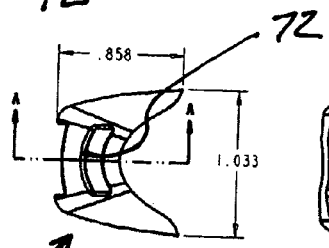
Figure 8C:
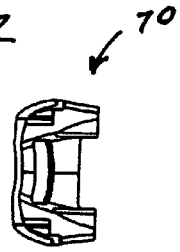
Figure 8E:
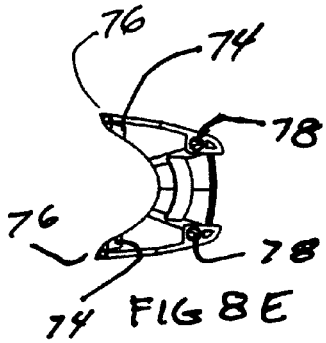
Figure 8F:
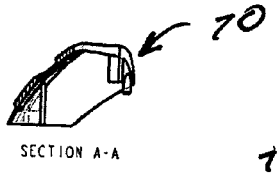
Figure 8H:
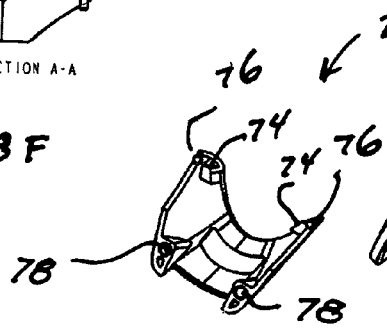
Figure 8I:
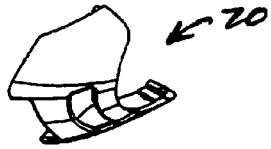
Figure 8G:
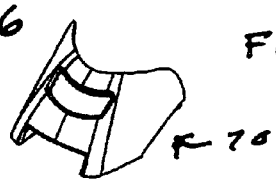

Referring to FIGS. 2–8, wherein in a first embodiment, the present invention is a goggle 10 for use by a person when swimming in water environment such as a swimming pool or at the beach. In one embodiment, the swim goggle 10 generally comprises first and second substantially rigid frames 12 and 13 each having a base portion 14, a raised eye lens portion 20, an inner end portion 22 and an outer end portion 24. The swim goggle 10 further comprises a bridge portion 26 for engaging the inner end portions 22 of the first and second frames 12 and 13. The swim goggle 10 further comprises a head strap 28 having first and second end portions 30 and 34. Each of the first and second end portions 30 and 34 have a plurality of tooth portions 32 and 36, respectively. The swim goggle 10 further comprises first and second connection mechanisms 38 and 68 disposed at the outer end portions of the first and second frames 12 and 13, respectively. Each of the first and second connection mechanisms 38 and 68 comprise a strap passage way 40 adapted to receive the first and second end portions 30 and 34 of the head strap 28. Each of the first and second mechanisms 38 and 68 further comprise an unitary formed resilient pawl 44 comprising a median portion 46 and first and second finger portions 48 and 54 each having end portions 50 and 56 engaged with the base portion 14 adjacent the raised eye lens portion 20. The resilient pawl 44 further comprises a button portion 60 extending upwardly from the median portion 46 and a stop portion 66 extending downwardly from the median portion 46. Each of the first and second connection mechanisms 38 and 68 further comprise a cover portion 70 engaged with the base portion 14 and the end portions 50 and 56 of the first and second finger portions 48 and 50 having an opening 72 to receive the upwardly extending button portion 60. In operation, movement of the button portion 60 away from the face of the person (not shown) causes the first and second finger portions 48 and 54 to become biased and the stop portion 66 to become disengaged from the tooth portions 32 and 36 of the strap 28. Release of the button portion 60 causes the stop portion 66 to become engaged with the tooth portions 32 and 36 of the head strap 28. The button portion 60 comprises an inner end portion 62 unitary with the median portion 46 and an outer end portion 64. Each of the first and second connection mechanisms 36 and 38 may comprise a pin 42 rotatably engaged within the strap passage way 40 to assist in movement of the end portions 30 and 34 of the head strap 28. The eye lens portion 20 is disposed above the base portion 14. The first and second finger portions 48 and 54 extend outward from the median portion 46 to engage with the base portion 14 adjacent to the eyes lens portion 20. Each of the end portions 50 and 56 of the first and second finger portions 48 and 54 comprises protrusions 52 and 58 extending downward from the end portions 50 and 56. Each base portion 14 comprises first and second inner recesses 16 disposed adjacent to the raised eye lens portion 20 and adapted to receive the downwardly extending protrusions 52 and 58 of the first and second finger portions 48 and 54, respectively. Each of the stop portions 66 comprise an elongated portion 68 having a width W1. Each of the button portions 60 have a width W2 that is substantially the same as the width W1 of the elongated portion 68 of the stop portion 44. The thickness of the button portion 60 is substantially the same as the thickness of the first and second fingers portions 48 and 54. Each of the strap passage ways 40 of the first and second connection mechanisms 38 and 68 are disposed outward of the outer end portions 24 of the frames 12 and 13, respectively. Each of protrusion 52 and 58 of the first and second finger portions 48 and 54 flare outward of the width W2 of the button portion 60 and engage with the inner recesses 16 formed in the base portion 14 at a point immediately adjacent the raised sidewall of the eye lens portion 20. The cover 70 further comprises inner bosses 74 and inner protrusions 76. The cover 70 is engaged upon the base portion 14 by mating the inner protrusion 76 with recesses 16 formed in the base portion 14 adjacent the eye lens portion 20 and mating the outer recess 78 with outward protrusions 17 of the base portion 14. Upon engagement of the cover 70, the inner bosses 74 engage and substantially fix the position of the protrusions 52 and 58 of the first and second finger portions 48 and 54. The first and second frames 12 and 13 and the cover 70 are made from a substantial rigid material such as polycarbonate. The unitary resilient member 44 is made from a self lubricating copolymer material having an acceptable resiliency and creep characteristics. In the embodiment shown, the unitary resilient member 44 is made from acetal. The pin portion 42 may be made from a variety of self lubricating, polymeric materials, such as acetal. All of the components of the invention may be made from conventional fabrication techniques such as injection molding.

The present invention can be embodied in other specific forms without departing from the spirit or essential characteristics thereof. For example, while the invention has been described in the context of swim goggles, the inventions described herein need not be limited to these illustrative embodiments. By way of example only, the teaching of the present invention can be used in connection with swim masks or any other type of eye protection goggles or masks used in a wide variety of application and/or other environments such as machinery operation, painting, sun protection, and hazardous materials.

What is claimed:

1. Swim goggles for use by a person comprising:

first and second substantially rigid frames each having a base portion, an eye lens portion, an inner end portion and an outer end portion;

a bridge for engaging said inner end portions of said first and second frames;

a head strap having first and second end portions; each of said first and second end portions having a plurality of tooth portions; and first and second connection mechanisms disposed at said outer end portions of said first and second frames, respectively; each of said first and second connection mechanisms comprising a strap passage way adapted to receive said first and second end portions of said head strap; each of said first and second mechanisms further comprising a unitary formed resilient pawl comprising a median portion and first and second finger portions having end portions engaged with said base portion adjacent said eye lens portion; said resilient pawl further comprising a button portion extending upwardly from said median portion and a stop portion extending downwardly from said median portion;

each of said first and second connection mechanisms further comprise a cover portion engaged with said base portion and said end portions of said first and second finger portions and having an opening to receive said upwardly extending button portion;

whereby movement of said button portion away from the face of the person causes said first and second finger portions to become biased and said stop member to become disengaged from said tooth portion of said strap and release of said button portion causes said stop member to be engaged with said tooth portion of said strap.

2. The swim goggles of claim 1, wherein each of said first and second connection mechanisms comprise a pin rotatably engaged within said strap passage way to assist in movement of said strap.

3. The swim goggles of claim 1, wherein said eye lens portion is disposed above said base portion.

4. The swim goggles of claim 3, wherein said first and second finger portions extend outward from said median portion to engage with said base portion adjacent said eyes lens portion.

5. The swim goggles of claim 4, wherein each of said end portions of said first and second finger portions comprise a protrusion extending downward from said end portions.

6. The swim goggles of claim 5, wherein each of said base portions comprises first and second recesses disposed adjacent said eye lens portion and adapted to receive said downwardly protrusions of said first and second finger portions, respectively.

7. The swim goggles of claim 6, wherein each of said stop portion comprises an elongated portion having a width W1.

8. The swim goggles of claim 7, wherein each of said button portion has a width W2 that is substantially the same as said width W1 of said stop portion.

9. The swim goggles of claim 8, wherein each of said thickness of said button portion is substantially the same thickness of said first and second fingers portions.

10. The swim goggles of claim 9, wherein each of said strap passage ways of said first and second connection mechanisms are disposed outward of said outer end portions of said base portions of said first and second connection mechanism, respectively.

11. The swim goggles of claim 10, wherein each protrusion of said first and second finger portions flare outward of said width W2 of said button member and engage with said recesses disposed in said base portion adjacent said eye lens portion.

12. The swim goggles of claim 11, wherein said first and second frames and said cover are made from a substantial rigid material.

13. The swim goggles of claim 12, wherein said first and second frames and said cover are made from polycarbonate.

14. The swim goggles of claim 13, wherein said unitary resilient member is made from a self lubricating copolymer material having a resiliency.

15. The swim goggles of claim 14, wherein said unitary resilient member is made from acetal.

16. The swim goggles of claim 15, wherein said pin portion is made from a self lubricating copolymer material having a resiliency.

17. The swim goggles of claim 16, wherein said pin is made from acetal.

* * * * *